US011541416B2

(12) United States Patent
Lavelanet

(10) Patent No.: US 11,541,416 B2
(45) Date of Patent: Jan. 3, 2023

(54) REUSABLE CARTRIDGE PISTON

(71) Applicant: Sulzer Mixpac AG, Haag (CH)

(72) Inventor: Richard Lavelanet, Balgach (CH)

(73) Assignee: MEDMIX SWITZERLAND AG, Haag (CH)

( * ) Notice: Subject to any disclaimer, the term of this patent is extended or adjusted under 35 U.S.C. 154(b) by 0 days.

(21) Appl. No.: 17/281,752

(22) PCT Filed: Aug. 13, 2019

(86) PCT No.: PCT/EP2019/071672
§ 371 (c)(1),
(2) Date: Mar. 31, 2021

(87) PCT Pub. No.: WO2020/069790
PCT Pub. Date: Apr. 9, 2020

(65) Prior Publication Data

US 2021/0387226 A1 Dec. 16, 2021

(30) Foreign Application Priority Data

Oct. 2, 2018 (EP) ..... 18198226

(51) Int. Cl.
*B05C 17/005* (2006.01)

(52) U.S. Cl.
CPC .. *B05C 17/00579* (2013.01); *B05C 17/00583* (2013.01)

(58) Field of Classification Search
CPC ..... B05C 17/00579; B05C 17/00583; B05C 17/00553
(Continued)

(56) References Cited

U.S. PATENT DOCUMENTS 2,371,332 A * 3/1945 Jacobson ..... B65D 83/0005 222/386
2,430,718 A * 11/1947 Jacobson ..... B65D 83/0005 222/386
(Continued)

FOREIGN PATENT DOCUMENTS

DE 10 2006 025 873 A1 12/2007
DE 10 2010 026 946 A1 1/2012
(Continued)

OTHER PUBLICATIONS

International Search Report dated Jan. 10, 2020 in corresponding International Patent Application No. PCT/EP2019/071672, filed Aug. 13, 2019.

*Primary Examiner* — Paul R Durand
*Assistant Examiner* — Michael J. Melaragno
(74) *Attorney, Agent, or Firm* — Global IP Counselors, LLP

(57) ABSTRACT

A reusable cartridge piston for use with film bag cartridges comprises a piston base, an intermediate portion and a piston head. An extension axis extends from the piston base through the intermediate portion and through the piston head. The piston also includes a lip sections extending radially outwardly with respect to the extension axis from a sidewall of the piston head, the piston base and the piston head being spaced apart from one another by the intermediate portion, with a gap between the piston base and the lip sections. The lip sections are respectively spaced apart from one another by slits formed between two neighboring lip sections, with the slits extending in a radial direction with respect to the extension axis of the piston. The piston base, the intermediate portion, the piston head and the lip sections are formed as one piece.

19 Claims, 3 Drawing Sheets

(58) Field of Classification Search
USPC ..... 222/386, 391
See application file for complete search history.

(56) References Cited

U.S. PATENT DOCUMENTS

| | | | | |
|---|---|---|---|---|
| 2,853,209 | A * | 9/1958 | Mcardle | B65D 1/0292 222/107 |
| 4,840,293 | A * | 6/1989 | Segatz | B05C 17/00576 222/326 |
| 4,854,485 | A | 8/1989 | Collins | |
| 4,986,444 | A | 1/1991 | Corso | |
| 5,184,757 | A * | 2/1993 | Giannuzzi | B05C 17/00506 141/334 |
| 5,593,066 | A * | 1/1997 | Konuma | B05C 17/00576 222/94 |
| 5,884,550 | A | 3/1999 | Northam | |
| 6,161,730 | A * | 12/2000 | Heusser | B05C 17/00506 222/137 |
| 6,352,177 | B1 * | 3/2002 | Bublewitz | A61C 5/64 222/82 |
| 6,578,738 | B1 * | 6/2003 | Keller | B29B 7/60 222/83 |
| 6,769,574 | B1 * | 8/2004 | Keller | B05C 17/00509 222/137 |
| 7,677,418 | B2 * | 3/2010 | Henniges | B01F 15/0279 222/327 |
| 7,891,528 | B2 | 2/2011 | Costa et al. | |
| 8,074,843 | B2 * | 12/2011 | Keller | B05C 17/00506 222/137 |
| 8,100,295 | B2 * | 1/2012 | Keller | B05C 17/00506 222/137 |
| 8,235,255 | B2 | 8/2012 | Springhorn et al. | |
| 8,505,785 | B2 | 8/2013 | Helmenstein | |
| 9,238,544 | B2 * | 1/2016 | Schulz | B65D 81/325 |
| 9,242,784 | B2 | 1/2016 | Buck et al. | |
| 9,469,061 | B2 | 10/2016 | Frey | |
| 9,555,928 | B2 * | 1/2017 | Ettlin | B65D 25/20 |
| 9,579,686 | B2 * | 2/2017 | Springhorn | B05C 17/00513 |
| 9,797,511 | B2 | 10/2017 | Bublewitz et al. | |
| 9,968,959 | B2 | 5/2018 | Frey | |
| 10,434,528 | B1 * | 10/2019 | Seiler | B05C 17/00583 |
| 10,968,031 | B2 * | 4/2021 | Turner | B05C 17/00579 |
| 2005/0029306 | A1 | 2/2005 | Brennan | |
| 2007/0158370 | A1 * | 7/2007 | Longo, II | B65D 83/0005 222/327 |
| 2007/0215649 | A1 * | 9/2007 | Tirone | B05C 17/0123 222/391 |
| 2007/0278251 | A1 * | 12/2007 | Guerrera | B05C 17/00576 222/327 |
| 2009/0065527 | A1 * | 3/2009 | Buck | B05C 17/00576 222/95 |
| 2009/0272767 | A1 * | 11/2009 | Herman | B05C 17/00583 222/326 |
| 2010/0237094 | A1 * | 9/2010 | Benjamin, II | B05C 17/0116 222/1 |
| 2011/0089200 | A1 | 4/2011 | Reuter | |
| 2011/0108573 | A1 * | 5/2011 | Stoeckli | B01F 15/0206 222/87 |
| 2012/0012615 | A1 * | 1/2012 | Habibi-Naini | B65D 83/0005 222/148 |
| 2013/0015205 | A1 * | 1/2013 | Hiemer | B29C 45/4407 222/137 |
| 2013/0105515 | A1 * | 5/2013 | Frey | B05C 17/00503 222/137 |
| 2014/0158717 | A1 * | 6/2014 | Ettlin | B05C 17/00559 222/327 |
| 2014/0361048 | A1 * | 12/2014 | Canel | A61M 5/145 222/386 |
| 2015/0102132 | A1 * | 4/2015 | Muller | B05B 7/066 239/335 |
| 2015/0114986 | A1 * | 4/2015 | Ngu | B05C 17/01 222/94 |
| 2015/0136812 | A1 * | 5/2015 | Krallmann | A47K 5/18 222/386 |
| 2017/0216874 | A1 * | 8/2017 | Turner | B05C 17/00583 |
| 2017/0259296 | A1 * | 9/2017 | Obrist | B05C 17/00579 |
| 2018/0229260 | A1 * | 8/2018 | Lavelanet | B05C 17/00506 |
| 2019/0241351 | A1 * | 8/2019 | Bodenmuller | B29C 45/36 |
| 2019/0322018 | A1 * | 10/2019 | Bodenmuller | B29C 45/14065 |
| 2020/0101488 | A1 * | 4/2020 | Bodenmuller | B32B 15/082 |
| 2020/0102122 | A1 * | 4/2020 | Seiler | B65D 81/32 |

FOREIGN PATENT DOCUMENTS

| | | | | |
|---|---|---|---|---|
| EP | 1 845 033 | A1 | 10/2007 | |
| EP | 1 836 100 | B1 | 4/2008 | |
| EP | 2 116 484 | A1 | 11/2009 | |
| EP | 2 998 030 | A1 | 3/2016 | |
| EP | 3714994 | A1 * | 9/2020 | B05C 17/00583 |
| JP | H08105197 | A | 4/1996 | |
| WO | 2018/058758 | A1 | 4/2018 | |

* cited by examiner

REUSABLE CARTRIDGE PISTON

CROSS-REFERENCE TO RELATED APPLICATIONS

This application is a U.S. National Stage application of International Application No. PCT/EP2019/071672, filed Aug. 13, 2019, which claims priority to European Patent Application No. 18198226.5, filed Oct. 2, 2018, the contents of each of which are hereby incorporated herein by reference.

BACKGROUND

Field of the Invention

The invention relates to a reusable cartridge piston for use with film bag cartridges, the piston comprising a piston base, an intermediate portion and a piston head, wherein an extension axis extends from the piston base through the intermediate portion and through the piston head, the piston further comprising a plurality of lip sections extending radially outwardly with respect to the extension axis from a sidewall of the piston head, the piston base and the piston head being spaced apart from one another by the intermediate portion, with a gap being present between the piston base and the plurality of lip sections, wherein the plurality of lip sections are respectively spaced apart from one another by slits formed between two neighboring lip sections, with the plurality of slits extending in a radial direction with respect to the extension axis of the piston.

Background Information

Conventional reusable cartridge pistons are well known in the art and are configured to be moveable along a discharging axis of a reusable cartridge from a storage position into a discharge position, thereby discharging a material stored in a deflatable film bag cartridge housed in a sleeve of the reusable cartridge. Here, the sleeve not only supports the film bag normally having a low rigidity but also guides the piston during its movement from the storage position into the discharge position. For the later purpose, at least an outer end part of each of the lip sections contacts an inner wall of the sleeve, thereby stabilizing the piston during its movement along the discharging axis of the reusable cartridge. After the material has been discharged from the film bag, the film bag can be removed from the reusable cartridge and replaced by a full new film bag. The reusable cartridge is then ready to be used again. As the reusable cartridge can be used again and only the film bag needs to be replaced, waste is avoided or at least minimized.

SUMMARY

It has been determined that in prior art reusable cartridge pistons, the piston base and the piston head are separate parts, requiring two different processing tools to fabricate each one of the piston base and piston head. Furthermore, the separate parts need to be assembled in a subsequent fabrication step to form the reusable cartridge piston. As a result, the fabrication of the reusable cartridge piston and therefore also the fabrication of the reusable cartridge is sophisticated and rather costly. Prior art pistons are known from US 2009/272767 A1; EP 2 998 030 A1; EP 1 845 033 A1; U.S. Pat. No. 4,986,444 A; and JP H08105197 A.

It is therefore an object of embodiments of the invention to create an easy to produce and inexpensive reusable cartridge. It is a further object of embodiments of the present invention to provide a reusable cartridge by which the film bag of a film bag cartridge can be reliably collected in order to prevent the film bag from becoming trapped between the cartridge sleeve and the piston and thus avoid the film bag from tearing which would significantly reduce the storage life of components stored in the film bag cartridge. It is yet a further object of embodiments of the present invention to make available a piston by which as much of the material stored in the film bag cartridge as possible is dispensable therefrom.

This object is satisfied by the subject matter disclosed herein.

According to a first aspect of the present invention, a reusable cartridge piston for use with film bag cartridges comprises a piston base, an intermediate portion and a piston head, wherein an extension axis extends from the piston base through the intermediate portion and through the piston head, the piston further comprising a plurality of lip sections extending radially outwardly with respect to the extension axis from a sidewall of the piston head the piston base and the piston head being axially spaced apart from one another along the extension axis by the intermediate portion, with a gap being present between the piston base and the plurality of lip sections, wherein the plurality of lip sections are respectively spaced apart from one another by slits formed between two neighboring lip sections, with the plurality of slits extending in a radial direction with respect to the extension axis of the piston, wherein the piston base, the intermediate portion, the piston head and the plurality of lip sections are formed as one piece.

Embodiments of the invention are based on the general idea of using a reusable cartridge piston that is of one piece design, i.e. in which a piston base, a piston head and an intermediate portion are integrally formed in one and the same injection mold in one injection molding step. On reducing the number of injection molding tools the pistons can be produced in one piece in a more facile and a more reproducible manner which thus leads to a more cost effective manufacture of the pistons, as one does not require the use of multiple processing tools.

Further benefits and advantageous embodiments of the invention will become apparent from the description and from the accompanying drawings.

As the piston is moved along the discharging axis of the reusable cartridge to discharge the material stored in the film bag, the film bag is deflated leaving an emptied film bag. In order to collect the empty part of the film bag, the reusable cartridge piston can comprise an annular groove, which is defined between the plurality of lip sections and the sidewall of the piston head. In other words the annular groove defined between the plurality of lip sections and the sidewall of the piston head receives or wraps up the emptied film bag.

During the collection of the film bag, it is important that the film bag does not get between the piston and the inner wall of the sleeve in order to avoid the film bag from being ruptured. To avoid such incidents, each of the plurality of lip sections can contact the inner wall of the sleeve, when the reusable cartridge piston is inserted into the sleeve. For this purpose, an outer diameter defined by the plurality of lip sections is larger than an inner diameter of the sleeve. Furthermore, each of the plurality of the lip sections can be resilient, that is each of the respective lip sections is moveable relative to the piston head and the piston base. Therefore, when the piston is inserted into the sleeve, each of the plurality of the lip sections pushes against the inner wall of the sleeve with its respective spring force.

In this connection it should be noted that the outer diameter of the piston as defined by the plurality of lip sections can also be equal to or smaller than the inner diameter of the sleeve. In this way the friction between the sleeve and the piston can be reduced and account can be production tolerances of the piston and the support sleeve.

However, to ensure that the resilient lip sections are not bent over or even break away from the piston head as the piston is moved along the discharging axis of the reusable cartridge, the gap between the piston head and the piston base is preferably 0.8 to 1.2 mm wide in the direction of the extension axis of the reusable cartridge piston. The piston base can act as a support for the bent lip sections which can then avoid the lip sections from being bent too much, in particular if a diameter of the piston head is smaller than a diameter of the piston base.

Furthermore, if the diameter of the piston head is smaller than the diameter of the piston base, sufficient support for the collected empty film bag is provided.

Preferably, the outer diameter of the piston base basically corresponds to the inner diameter of the sleeve into which the film bag and the piston are inserted, so that the piston base is at least partially in contact with the inner wall of the sleeve. Such a configuration of the piston base allows for a secure guidance of the piston in the sleeve during the movement of the piston along a discharge axis of the reusable cartridge. Furthermore, if the diameter defined by the plurality of the lip sections is larger than the diameter of the piston base, it is ensured that the plurality of lip sections push against the inner wall of the sleeve, when the piston is inserted into the sleeve, thereby preventing that the emptied bag gets between the piston and the inner wall of the sleeve.

Optimum results with regard to emptying the film bag as completely as possible, and ideally entirely, are achievable if the piston head preferably comprises a front face which faces away from the piston base of the piston and which forms a flat plane or an at least substantially flat plane. This reduces the amount of waste left behind in a film bag cartridge.

Discharging properties can be further enhanced if the front face of the piston head is spaced further apart from the piston base than the lip sections. In other words the front face of the piston head projects beyond the outermost tips of each of the lip sections. By the numbers, the front face preferably projects by 5% to 50% of the height of the piston beyond each of the lip sections. Furthermore, if the piston head is spaced further apart from the piston base than the lip sections, sufficient space for collecting the emptied film bag is provided.

Optimum results with regard to the flexibility of each of the lip sections are achieved, when the plurality of slits separating the plurality of lip sections preferably extend from the outside radially inwardly to the sidewall of the piston head. Preferably, at least one of the plurality of slits can pass over into a channel present in the sidewall of the piston head. It is even more preferred, if each of the plurality of slits passes over into a channel present in the sidewall of the piston head. The channels can be basically aligned in parallel to the extension axis of the piston. Such an alignment of the channels promotes sufficient emptying of the film bag.

In this connection it should be noted that a gap formed between directly adjacent lip sections is non-uniform, especially wherein the gap comprises first and second slit sections, with a spacing between the first slit sections being smaller than a spacing between the second slit sections. By forming the gap non-uniform the tools used for an injection mold can be simplified making it possible simpler to form a one-piece piston and hence facilitates the reduction of the cost of manufacture of the piston.

Preferably the processing tool for fabricating the reusable cartridge piston is an injection molding tool. In order to avoid undesired shrinkage of the injection molded piston during its cooling, and in particular to avoid undesired shrinkage of the plurality of lip sections of the piston, at least one of the inner surfaces of the plurality of lip sections facing the sidewall of the piston head can comprise at least one recess.

Preferred materials used for the fabrication of the reusable cartridge piston can be in particular POM, PTFE, PA or a polymer or a thermoset material having a hardness measured with the Shore D Durometer selected in the range of 55 D to 100 D. Most preferably, the reusable cartridge piston is made of only one composition, preferably comprises only one polymeric material.

The polymeric material can include polymer blends, i.e. can also contain additives, primers and/or polar groups and may not be one single virgin polymer.

In this connection it should further be noted that a material of the piston may be one of polyethylene (PE), high density polyethylene (HD-PE), polybutylene terephthalate (PBT), polyamide (PA) and polypropylene (PP).

In order to prevent the piston from falling out of the sleeve in an undesirable manner after the material stored in a film bag has been discharged therefrom, the piston can comprise at least one fall-out protector present in a sidewall of the piston base, preferably wherein the at least one fall-out protector is formed by a notch in the sidewall of the piston base. This fall-out protector is configured to cooperate with a corresponding structure formed in the sleeve.

Since the piston may need to be replaced, e.g. due to failure of the piston or a part thereof, or maintained e.g. due to contamination present at the piston, it is beneficial if the fall-out protector is formed such that the piston may be removed from the sleeve.

A sealing element may be arranged at the piston, preferably at the piston base, in order to enhance a seal between the piston and the sleeve with which it cooperates. The sealing element may comprise an O-ring, such as an ethylene propylene diene monomer rubber (EPDM) O-ring or a silicone O-ring.

It should further be noted that the pistons described herein can be used in a plurality of different types of cartridges, for example, one or multi-component cartridges. If e.g. a two-component cartridge is used this may be formed as a side-by-side cartridge, a coaxial cartridge or a cartridge formed by joining two single component cartridges e.g. by a "click together" process such as a snap-fit connection or the like.

The invention is also directed at a sleeve for one or more reusable cartridge pistons, the sleeve can comprise at least one cylindrical passage extending between front and rear ends of the sleeve, with at least one projection being respectively arranged at the front and/or rear ends of the sleeve. Such a projection is preferably adapted to fulfill two functions. The first function is to allow the piston to be removed from the sleeve via the fall-out protector present in the sidewall of the piston base of the piston. The second function is to hold the piston in the sleeve and to thereby prevent it from falling out of the sleeve when the film bag cartridge is removed.

For this purpose, the fall-out protector may be formed as a notch in the sidewall of the piston base of the piston. It is to be noted, that the fall-out protector may also be a protrusion protruding from the sidewall of the piston base of the piston, which interacts with a notch formed on the inner sidewall of the sleeve. Moreover, the sidewall of the piston base of the piston can comprise at least two fall-out protectors, one of which is a protrusion and the other one being a notch. Consequently, the sleeve comprises a corresponding notch and a corresponding insertion. Such an arrangement of the fall-out protectors allows for an unambiguous insertion of the piston into the sleeve of the cartridge.

The film bag cartridge can be configured to be used for discharging more than one material. For example the film bag cartridge can be used to simultaneously discharge each component of a two or more component adhesive. In order to separately store each component, the sleeve can comprise two or more cylindrical passages, with the two or more cylindrical passages being fixedly connected to one another or being integrally formed with one another. Each passage can then store a film bag, in particular wherein a different material is stored in each of the film bags. The different materials can be components of a two or more component adhesive.

For safe storage of the film bag in the sleeve, the front end of the sleeve can be configured to be coupled to a film bag cartridge and/or to a head part of a film bag cartridge.

Not only can the piston of the reusable cartridge be formed by injection molding, but the sleeve can also be injection molded using a plastic material. According to another aspect of the invention, the sleeve can also be an extruded aluminum.

Embodiments of the invention are also directed to a reusable cartridge comprising at least one reusable piston inserted into at least one sleeve and a film bag cartridge filled with a material, with the at least one reusable piston being movable in the sleeve between a storage position and a discharge position along a discharging axis of the reusable cartridge, thereby discharging the material stored in the film bag from the cartridge, wherein the discharging axis of the reusable cartridge and the extension axis of the piston are aligned in parallel to each other.

A further aspect of embodiments of the present invention relates to a dispenser comprising a push rod configured to move the reusable cartridge piston to and fro along the extension axis, wherein the push rod is configured to be coupled to the reusable cartridge piston or is fixedly connected to the reusable cartridge piston, optionally wherein the dispenser further comprises at least one of the reusable cartridge and the sleeve. By forming the piston at the dispenser in this manner one can ensure that the piston is always correctly inserted into the sleeve.

BRIEF DESCRIPTION OF DRAWINGS

The invention will be explained in more detail hereinafter with reference to the drawings.

DETAILED DESCRIPTION

Figure 1:
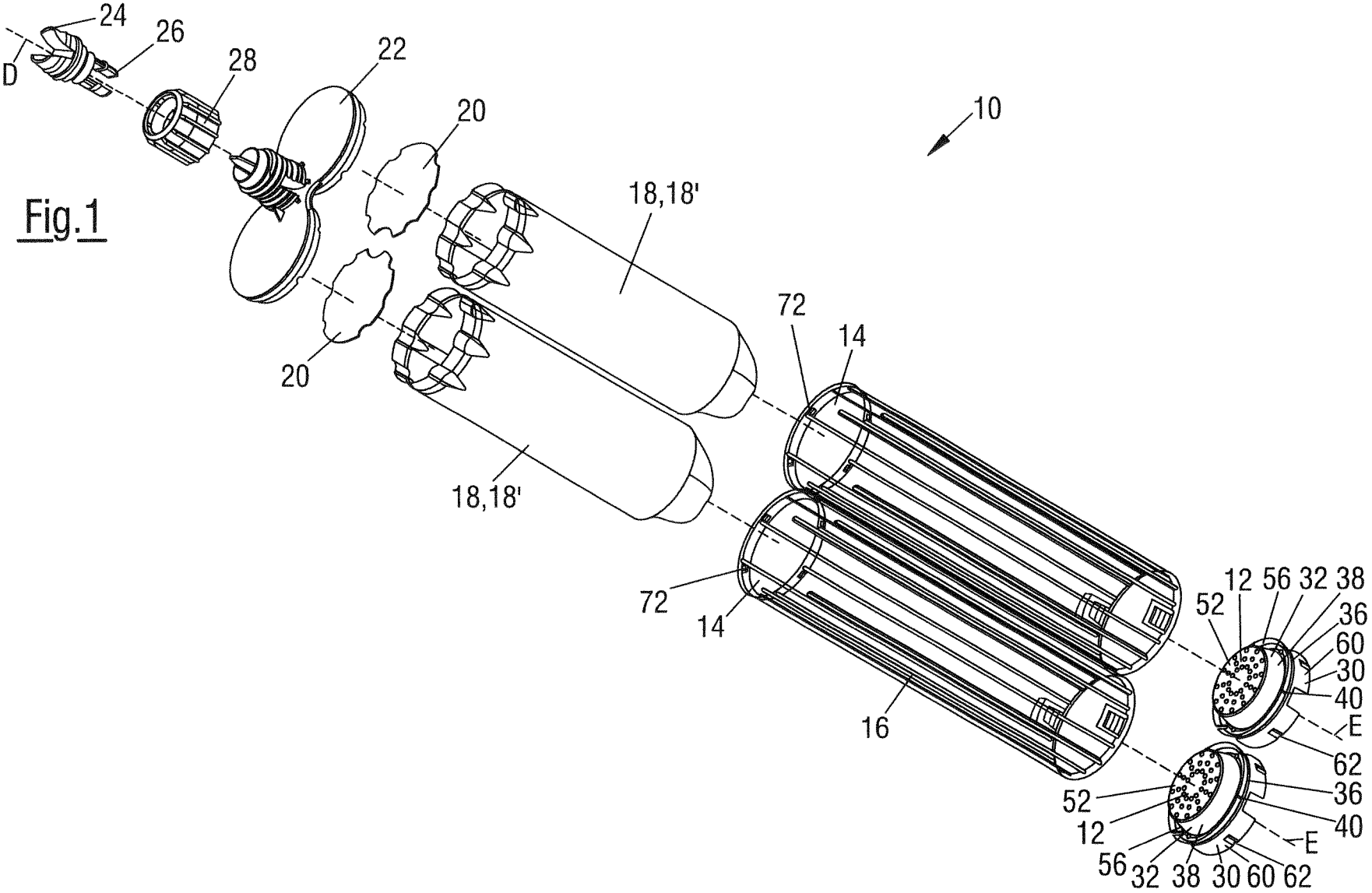
FIG. 1 shows an exploded view of a reusable film bag cartridge.

In the following the same reference numerals will be used for parts having the same or equivalent function. Any statements made having regard to the direction of a component are made relative to the position shown in the drawing and can naturally vary in the actual position of application.

FIG. 1 shows an exploded view of a reusable film bag cartridge 10. The reusable film bag cartridge 10 shown in FIG. 1 is configured to discharge two materials, such as a multi-component adhesive comprising a binder and a hardener. The reusable film bag cartridge 10 comprises two pistons 12 which will be described below in detail with respect to FIGS. 2 to 6.

Each piston 12 is inserted into a cylindrical passage 14 of a sleeve 16, with each of the passages 14 storing a film bag cartridge 18 comprising a film 20 that is fixedly connected to a head part 22 of the film bag cartridge 18.

The two passages 14 are fixedly connected to each other. However, the two passages 14 may also be integrally formed with one another. It is to be understood that the reusable cartridge 10 can also comprise only one passage 14 or more than two passages 14, to store only one material or more than two materials, respectively.

The sleeve 16 is configured to be coupled to the head part 22 of the film bag cartridge 18, with the head part 22 comprising an outlet 24. The outlet 24 can be coupled to a mixing element (not shown) in use. In the storage state the outlet 24 can be sealed off using a plunger 26. According to the design of the reusable film bag cartridge 10 shown in FIG. 1, the head part 22 is sealed off by the plunger 26 by means of a cap nut 28. It is to be understood that the sleeve 16 may also be coupled to a film bag cartridge 10 by inserting the sleeve 16 into a corresponding seat configured to receive the sleeve 16 therein. In the example shown the head part 22 is integrally formed with a film 18' to form the film bag cartridge 18.

The sleeve 16 is preferably an extruded aluminum sleeve. Alternatively, the sleeve 16 can be formed from an injection molded plastic material.

The respective sleeve 16 comprises projections 72 arranged at the front end of the sleeve 16 at an inner surface of the passage 14.

Figure 2:
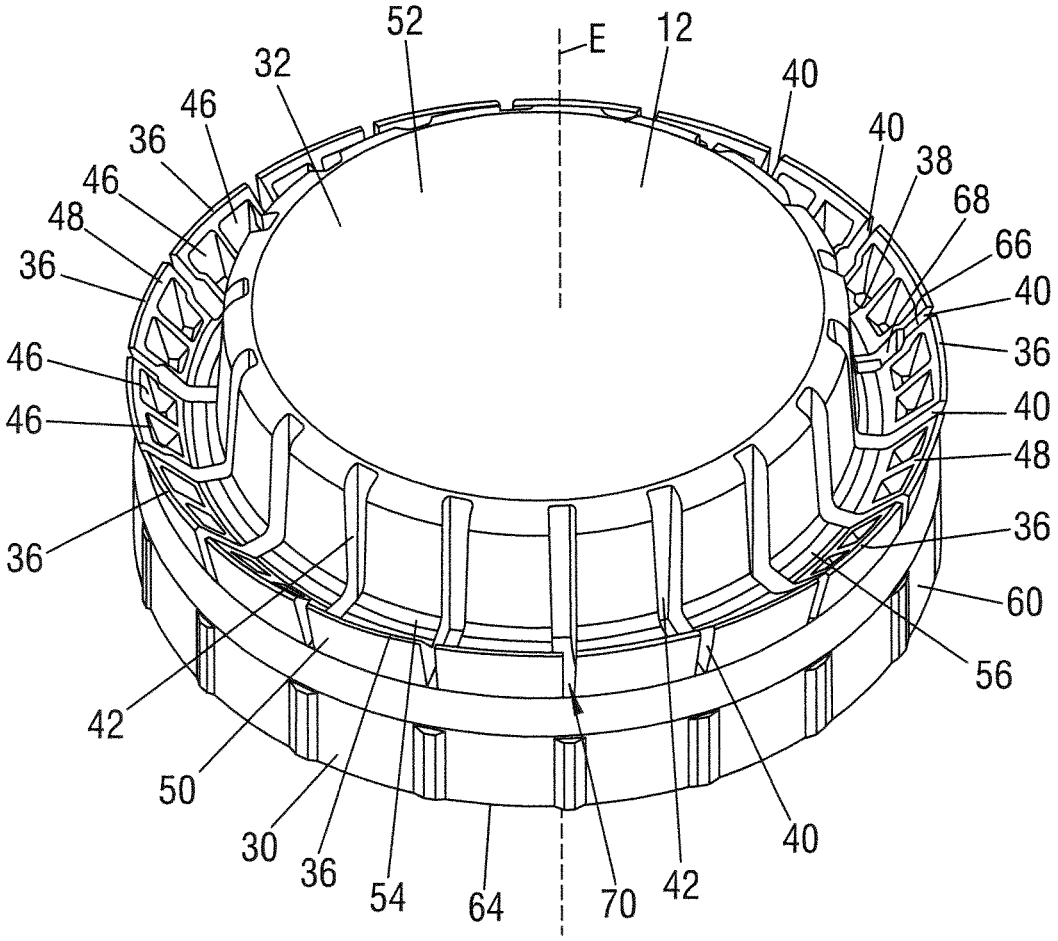
FIG. 2 shows a perspective view of a first design of a piston for use with the reusable film bag cartridge of FIG. 1.
Figure 3:
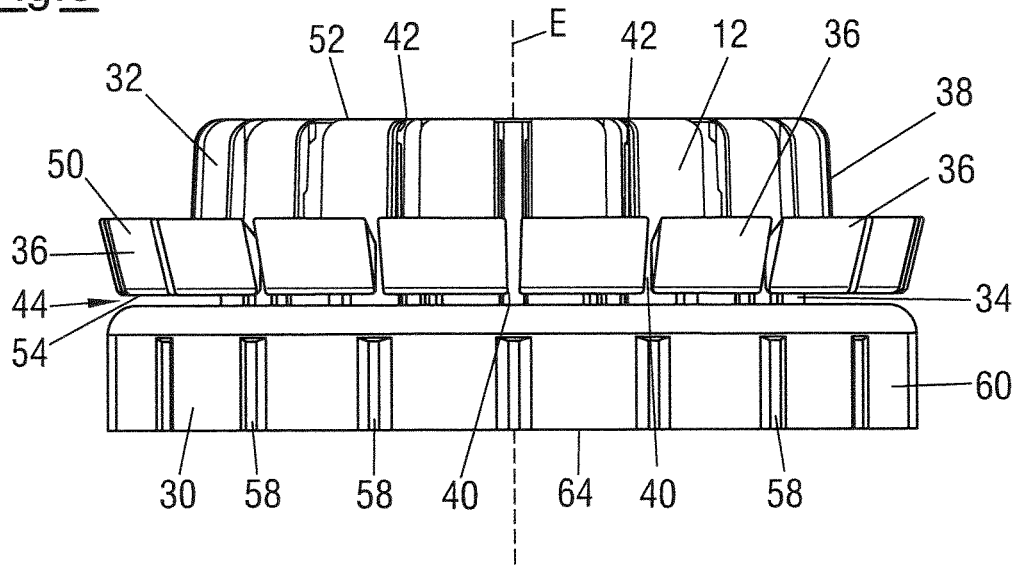
FIG. 3 shows a side view of the piston of FIG. 2.

Now turning to the description of the pistons 12 shown in detail FIGS. 2 to 6, wherein FIGS. 2 and 3 show a piston 12 according to a first design and FIGS. 3 to 6 show a piston 12 according to a second design. The piston 12 according to the first design basically differs from the piston 12 according to the second design in size and the resultant reduction in number of parts associated therewith. Unless described otherwise, the pistons 12 according to the first and second designs are basically identical in function.

Figure 6:
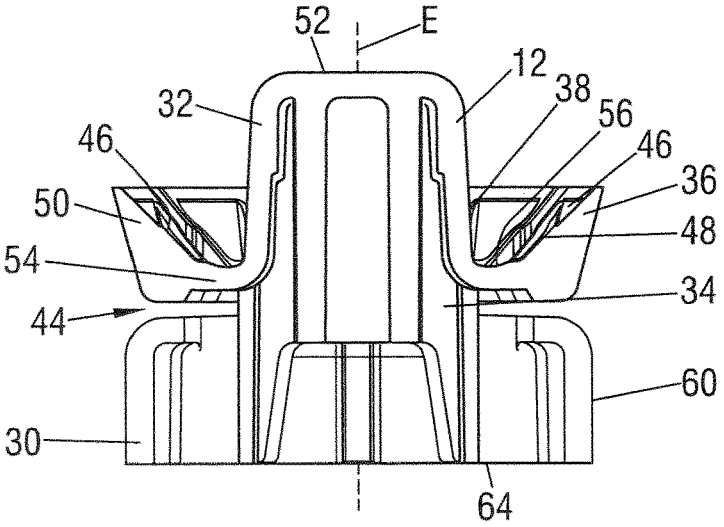
FIG. 6 shows a cross-sectional view of the piston of FIG. 4.

Each piston 12 comprises a piston base 30 and a piston head 32, which are connected to each other by an intermediate portion 34 (FIGS. 3 and 6). An extension axis E of the piston 12 extends from the piston base 30 through the intermediate portion 34 and through the piston head 32. The extension axis E of the piston 12 and a discharging axis D of the reusable film bag cartridge 10 are aligned in parallel to each other, when the piston 12 is inserted into the passage 14 of the sleeve 16.

The piston 12 further comprises a plurality of lip sections 36 extending radially outwardly with respect to the extension axis E from a sidewall 38 of the piston head 32. The plurality of lip sections 36 are respectively spaced apart from one another by slits 40 being formed between two neighboring lip sections 36. The plurality of slits 40 separating the plurality of lip sections 36 extend from the outside radially inwardly towards the sidewall 38 of the piston head 32. As the piston 12 according to the first design is larger than the piston 12 according to the second design, the piston 12 according to the first design comprises more lip sections 36 than the piston 12 according to the second design. Furthermore, each of the slits 40 of the piston 12 according to the first design passes over into a channel 42 being aligned basically in parallel to the extension axis E of the piston 12.

Figure 5:
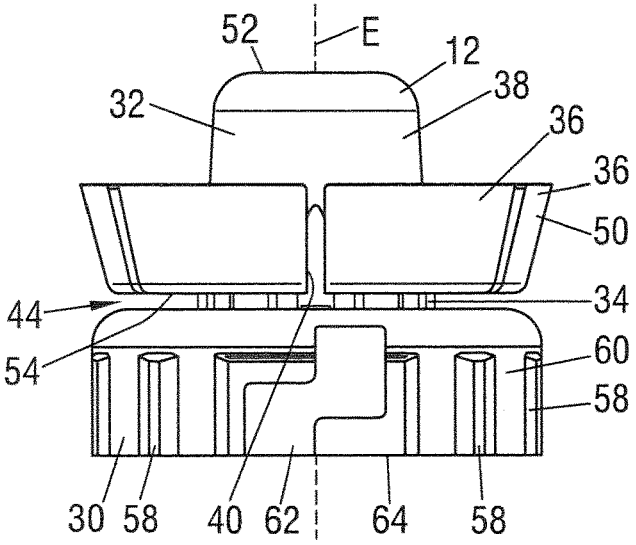
FIG. 5 shows a side view of the piston of FIG. 4.

As can be seen best from FIGS. 3, 5 and 6, the piston base 30 and the piston head 32 are spaced apart from each other by the intermediate portion 34 along the extension axis E, thereby forming a gap 44 between the plurality of lip sections 36 and the piston base 30 of the piston 12. The gap 44 thus axially separates the piston base 30 and the piston head 32 at the extension axis E. Nevertheless, the piston base 30, the piston head 32, the intermediate portion 34 and the plurality of lip sections 36 are formed as one piece, i.e. all components of the piston 12 are formed integrally.

Preferably, the piston 12 is injection molded from only one material, in particular POM, PTFE, PA or a polymer or a thermoset material having a hardness measured with the Shore D Durometer selected in the range of 55 D to 100 D.

As is well known in the art, a hot injection molded material may shrink during its cooling. However, in order to overcome this drawback, and in particular to retain the size of the plurality of lip sections 36, each lip section 36 comprises at least one recess 46 on an inner surface 48 facing the sidewall 38 of the piston head 32. As can be seen best in FIGS. 2 and 5, two recesses 46 are formed on the inner surface 48 per each lip section 36. It is to be understood that each lip section 36 can comprise more or less than two recesses 46. Furthermore, the recesses 46 are formed on an outer portion 50 of the lip section 36 inclined outwardly towards a front face 52 with respect to the extension axis E of the piston 12. It is to be understood, that the outer portion 50 of the lip can also be formed without a recess 46.

Each of the lip sections 36 not only comprises an outer portion 50 inclined outwardly towards the front face 52 with respect to the extension axis E of the piston 12, but also comprises a radial portion 54 which extends from the sidewall 38 of the piston head 32 radially outwardly with respect to the extension axis E of the piston 12.

Furthermore, each of the respective lip sections 36 is moveable relative to the piston head 32 and the piston base 30. Additionally, as can be seen from the side views of the piston 12 shown in FIGS. 3 and 5, a diameter defined by the plurality of the lip sections 36 is larger than a diameter of the piston base 30, so that the resilient lip sections 36 push against an inner wall of the passage 14 of the sleeve 16, when the piston 12 is inserted into a corresponding passage 14 of the sleeve 16. However, in order to ensure that during the movement of the piston 12 along the dispersing axis D of the cartridge 10 none lip section 36 of the plurality of lip sections 36 is bend over too much and eventually breaks away from the piston head 32, the gap 44 formed between the plurality of lip sections 36 and the piston base 30 is 0.8 to 1.2 mm wide in the direction of the extension axis E of the reusable cartridge piston 12, so that the piston base 30 acts as a support for the plurality of lip sections 36 deflected towards the piston base 30.

The lip sections 36 are resilient or flexible and moveable relative to the piston 12 and piston base 30 without breaking, and are embodied to be movable based on a force of inserting these into the sleeve 16 mechanically by hand, although one could potentially use compressed air (e.g. 6.9 bar) for assistance.

On dispensing the material stored in the film bag cartridge 18 pressures in the range of 10 to 50 bar are exerted onto the piston base 30 via a dispenser and to dispense materials stored in the film bag cartridge 18. These pressures are transferred via the piston 12 and the plurality of lip sections 36 to the film bag cartridge 18. The lip sections 36 like the piston 12 have to be configured such that they can cope with this transfer of pressures from the dispenser to the film bag cartridge 18.

When the piston 12 is inserted into a passage 14 of a sleeve 16, the piston 12 is configured to be moved from a storage position into a discharge position along the discharging axis D of the reusable film bag cartridge 10, thereby discharging the material stored inside the film bag cartridge 18. In order to collect the part of the emptied film bag cartridge 18, the plurality of lip sections 36 and the sidewall 38 of the piston head 32 define an annular groove 56 therebetween, which receives and collects the empty part of the film bag cartridge 18.

Furthermore, in order to guide the piston 12 during its movement along the discharging axis D of the cartridge 10, the piston base 30 can comprise a plurality of guide structures 58 present at the sidewall 60 of the piston base 30. The guide structures 58 are formed as axially aligned protrusions protruding from the sidewall 60 of the piston base 30 that can engage corresponding channels present in the sleeve 16.

Alternatively, the guide structures 58 of the piston 12 can also be formed as channels, if the passage 14 of the sleeve 16 comprises corresponding protrusions.

In this connection it should be noted that the sleeve 16 and/or the piston 12 can be formed without such guide structures 58 and simply have an inner surface without recesses or protrusions formed therein.

As the piston 12 moves along the discharging axis D of the reusable film bag cartridge 10, the front face 52 facing away from the piston base 30 and formed at the piston head 32 is pushed against the film bag cartridge 18, thereby pushing the material stored inside the film bag cartridge 18 out of the same.

Advantageous dispensing results are achieved if the front face 52 of the piston 12 forms a flat surface and is spaced further apart in the direction of the extension axis E of the piston 12 from the piston base 30 than the lip sections 36. Preferably, the front face 52 projects by 5% to 50% of the height of the piston 12 beyond each of the lip sections 36. The height of the piston is generally measured as the largest distance measured in parallel to the extension axis E between the front face 52 and an end face 64 of the piston base 30 remote from the front face 52.

Figure 4:
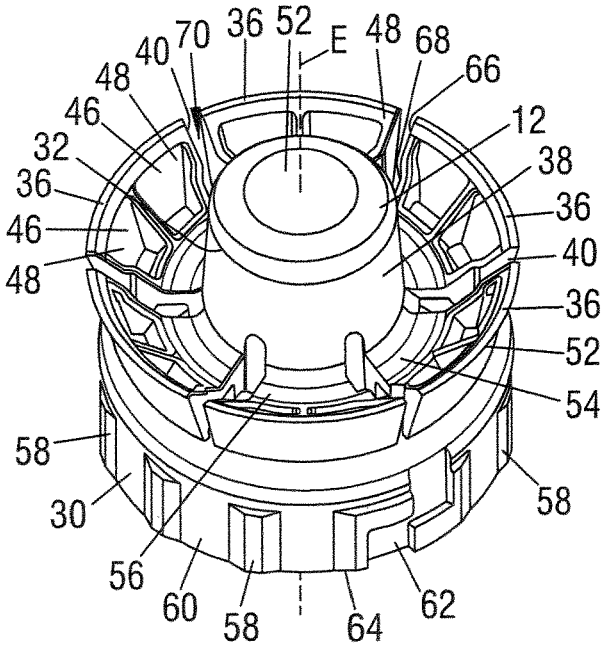
FIG. 4 shows a perspective view of a second design of a piston for use with the reusable film bag cartridge of FIG. 1.

As can be seen best from FIGS. 4 and 5, the piston 12 according to the second design comprises a fall-out protector 62 that is used in conjunction with corresponding features present at the sleeve 16 to ensure that the piston 12 does not fall out of the sleeve during the replacement of an empty film bag cartridge 18 with a full new film bag cartridge 18.

The fall-out protector 62 is formed as a notch basically aligned parallel to the extension axis E of the piston 12 and having an offset in circumferential direction of the piston base 30 of the piston 12. The fall-out protector 62 is configured to interact with the projection 72 that is arranged at the front end of the passage 14 of the sleeve 16. It is to be understood that the piston 12 according to the first design can also comprise at least one fall-out protector 62. It should be noted that more than one projection 72 can be arranged at the front end and that additionally or alternatively the one or more projections 72 can also be arranged at the rear end of the sleeve 16.

Discharging of a material from a reusable film bag cartridge 10 functions as follows: first the film bag cartridge 18 is placed inside the passage 14 of the sleeve 16; then a force is applied on the piston 12 that is transferred to the film bag cartridge 18 which is thereby squeezed to subsequently dispense the material stored therein via the head part 22. As a result the material will overcome the film 20 and will be forced out of the cartridge 10 through the outlet 24 and eventually through the mixing element.

After the material has been discharged from the film bag cartridge 18, the piston 12 can be removed out of the passage 14 of the sleeve 16, e.g. for maintenance of the piston or to replace a damaged piston. This is typically done when the film bag cartridge 18 is removed from the sleeve 168. The piston 12 or a new piston 12 may then be inserted again into the passage 14 of the sleeve 16, the reusable film bag cartridge 10 is then ready for use again.

It should further be noted that a thickness of the respective lip section 36 is important. If the thickness is too thin the lip section 36 may be too fragile or breakable, if it is too thick it will not be easily moveable. Thus the typical thicknesses of the lip sections 36 will be on the order of mm's, for example 2 mm or less or 0.8 to 1.5 mm in thickness.

It should further be noted that the geometric form of the respective lip section 36 is not specifically limited, and it may be polygonal, rectangular, pentagonal, square, hexagonal, octagonal, or triangular etc.

The number of lip sections 36 is also not specifically limited and typically can vary from 4 to 30, in particular 6 to 20. The larger the number of lip sections 36 is, the more flexible these are and hence a larger number of lip sections 36 is better for larger diameter pistons 12. The trade-off is that the dies and injection molding equipment required to produce such a piston are more complicated in comparison to pistons 12 having a smaller number of lip sections 36.

As indicated in both FIGS. 2 and 4, the slits 40 present between the lip sections 36 are not uniformly spaced apart, but rather comprise first and second slit sections 66, 68, so that a gap 70 formed between directly adjacent lip sections 36 is non-uniform. A spacing of the gap 70 between the first slit sections 66 is smaller than a spacing of the gap 70 between the second slit sections 68. The spacing of the gap 70 between the second slit section 68 is approximately 1.2 to 1.8 times as large as the spacing of the gap 70 between the first slit section 66.

It should be noted in this connection that it is preferred if the first slit section 66 is smaller than the second slit section 68, with the first slit section 66 preferably being arranged further towards the outer circumference of the piston 12 than the second slit section 70.

It should further be noted that the slits 40 and/or the annular groove 56 is/are not specifically limited as to form and they may be polygonal, rectangular, triangular, U-shaped, V-shaped etc.

It should further be noted that the number of slits 40 is not specifically limited may often be 4 to 30, typically 6 to 20. In the event that any of the lip sections 36 are offset to each other vertically with respect to the extension axis E, then a comparison is made between an average gap 44 width between directly adjacent lip sections 36 by assuming they are arranged in the same plane.

The invention claimed is:

1. A reusable cartridge piston for use with film bag cartridges, the piston comprising:

a piston base;

an intermediate portion;

a piston head, an extension axis extending from the piston base through the intermediate portion and through the piston head; and a plurality of lip sections extending radially outwardly with respect to the extension axis from a sidewall of the piston head, the piston base and the piston head being axially spaced apart from one another along the extension axis by the intermediate portion, with a gap being present between the piston base and the plurality of lip sections, the gap axially separating the plurality of lip sections and the piston base in a direction of the extension axis, and the plurality of lip sections being respectively spaced apart from one another by slits disposed between two adjacent lip sections, with the slits extending in a radial direction with respect to the extension axis of the piston, the piston base, the intermediate portion, the piston head and the plurality of lip sections being formed as one piece, and the plurality of lip sections and the sidewall of the piston head define an annular groove therebetween.

2. The reusable cartridge piston in accordance with claim 1, wherein each of the lip sections is moveable relative to the piston head and the piston base.

3. The reusable cartridge piston in accordance with claim 1, wherein a diameter defined by the plurality of lip sections is larger than or equal to a diameter of the piston base.

4. The reusable cartridge piston in accordance with claim 1, wherein the piston head comprises a front face which faces away from the piston base of the piston and which forms a flat plane or an at least substantially flat plane.

5. The reusable cartridge piston in accordance with claim 1, wherein the slits separating the plurality of lip sections extend from an outside radially inwardly to the sidewall of the piston head, or another gap formed between directly adjacent lip sections is non-uniform, especially wherein the another gap comprises first and second slit sections, with a spacing between the first slit sections being smaller than a spacing between the second slit sections.

6. The reusable cartridge piston in accordance with claim 1, wherein the reusable cartridge piston is formed from only one composition or the reusable cartridge piston is formed from only POM, PTFE, PA or a polymer or a thermoset material having a hardness measured with the Shore D Durometer selected in the range of 55 D to 100 D.

7. The reusable cartridge piston in accordance with claim 1, wherein the piston comprises at least one fall-out protector disposed in a sidewall of the piston base.

8. A reusable cartridge piston in accordance with claim 7, wherein the at least one fall-out protector is formed by a notch in the sidewall of the piston base.

9. A sleeve for the reusable cartridge piston in accordance with claim 1, the sleeve comprising:

one, two or more cylindrical passages extending between front and rear ends of the sleeve, with at least one projection being arranged at the front or rear ends of the sleeve.

10. The sleeve in accordance with claim 9, wherein two or more cylindrical passages are provided, with the two or more cylindrical passages being fixedly connected to one another or being integrally formed with one another.

11. The sleeve in accordance with claim 9, wherein the front end of the sleeve is configured to be coupled to a reusable film bag cartridge or to a head part of a reusable film bag cartridge.

12. The sleeve in accordance with claim 9, wherein the sleeve is an extruded aluminum sleeve or an injection molded plastic material.

13. A reusable cartridge comprising:

the reusable cartridge piston according to claim 1;

a sleeve; and a film bag cartridge filled with a material, with the reusable cartridge piston being movable in the sleeve between a storage position and a discharge position along a discharging axis of the reusable cartridge, thereby discharging the material stored in the film bag cartridge from the cartridge, the discharging axis of the reusable cartridge and the extension axis of the piston being aligned in parallel to each other.

14. A dispenser comprising:

a push rod configured to move the reusable cartridge piston in accordance with claim 1 to and fro along the extension axis, the push rod capable of being coupled to the reusable cartridge piston or is fixedly connected to the reusable cartridge piston.

15. The dispenser accordingly to claim 14, further comprising a sleeve including at least one cylindrical passage extending between front and rear ends of the sleeve, with at least one projection being arranged at the front or rear ends of the sleeve.

16. A reusable cartridge piston for use with film bag cartridges, the piston comprising:

a piston base;

an intermediate portion;

a piston head, an extension axis extending from the piston base through the intermediate portion and through the piston head; and a plurality of lip sections extending radially outwardly with respect to the extension axis from a sidewall of the piston head, the piston base and the piston head being axially spaced apart from one another along the extension axis by the intermediate portion, with a gap being present between the piston base and the plurality of lip sections, the gap axially separating the plurality of lip sections and the piston base in a direction of the extension axis, and the plurality of lip sections being respectively spaced apart from one another by slits disposed between two adjacent lip sections, with the slits extending in a radial direction with respect to the extension axis of the piston, the piston base, the intermediate portion, the piston head and the plurality of lip sections being formed as one piece, and the gap is 0.8 to 1.2 mm wide in a direction of the extension axis of the reusable cartridge piston.

17. A reusable cartridge piston for use with film bag cartridges, the piston comprising:

a piston base;

an intermediate portion;

a piston head comprising a front face which faces away from the piston base of the piston and which forms a flat plane or an at least substantially flat plane, an extension axis extending from the piston base through the intermediate portion and through the piston head; and a plurality of lip sections extending radially outwardly with respect to the extension axis from a sidewall of the piston head, the piston base and the piston head being axially spaced apart from one another along the extension axis by the intermediate portion, with a gap being present between the piston base and the plurality of lip sections, the gap axially separating the plurality of lip sections and the piston base in a direction of the extension axis, and the plurality of lip sections being respectively spaced apart from one another by slits disposed between two adjacent lip sections, with the slits extending in a radial direction with respect to the extension axis of the piston, the piston base, the intermediate portion, the piston head and the plurality of lip sections being formed as one piece, and the front face spaced further apart from the piston base than the lip sections in a direction in parallel to the extension axis, or the front face projects by 5% to 50% of a height of the piston beyond each of the lip sections, with the height being measured between the front face and an end face of the piston base remote from the front face.

18. A reusable cartridge piston in accordance with claim 17, wherein the front face projects by 5% to 50% of the height of the piston beyond each of the lip sections, with the height being measured between the front face and an end face of the piston base remote from the front face.

19. A reusable cartridge piston for use with film bag cartridges, the piston comprising:

a piston base;

an intermediate portion;

a piston head, an extension axis extending from the piston base through the intermediate portion and through the piston head; and a plurality of lip sections extending radially outwardly with respect to the extension axis from a sidewall of the piston head, the piston base and the piston head being axially spaced apart from one another along the extension axis by the intermediate portion, with a gap being present between the piston base and the plurality of lip sections, the gap axially separating the plurality of lip sections and the piston base in a direction of the extension axis, and the plurality of lip sections being respectively spaced apart from one another by slits disposed between two adjacent lip sections, with the slits extending in a radial direction with respect to the extension axis of the piston, the piston base, the intermediate portion, the piston head and the plurality of lip sections being formed as one piece, and an inner surface of at least one of the plurality of lip sections, which faces the sidewall of the piston head, comprising at least one recess.

* * * * *